US005105330A

United States Patent [19]

Hiwada

[11] Patent Number: 5,105,330

[45] Date of Patent: Apr. 14, 1992

[54] SCOROTRON TYPE CHARGING APPARATUS

[75] Inventor: Shuhei Hiwada, Toyohashi, Japan

[73] Assignee: Brother Kogyo Kabushiki Kaisha, Japan

[21] Appl. No.: 511,741

[22] Filed: Apr. 20, 1990

[30] Foreign Application Priority Data

May 26, 1989 [JP] Japan ..... 1-61276[U]

[51] Int. Cl.[5] ..... G03G 15/02; G05F 1/656

[52] U.S. Cl. ..... 361/225; 361/235

[58] Field of Search ..... 361/225, 235, 230, 57, 361/212, 91; 355/14, 225

[56] References Cited

U.S. PATENT DOCUMENTS 3,909,614 9/1975 Marshall ..... 361/225
3,980,929 9/1976 Bresnick ..... 361/57
4,868,907 9/1989 Folkins ..... 361/235

*Primary Examiner*—J. R. Scott
*Assistant Examiner*—S. Jackson
*Attorney, Agent, or Firm*—Oliff & Berridge

[57] ABSTRACT

A grid electrode voltage control aparatus is for a scorotron charging device having a corona discharge electrode operatively connected to a corona producing power source and disposed opposite a counter electrode, and a grid electrode disposed between the corona discharge electrode and the counter electrode. A shunt-regulated stabilized power supply is operatively connected to the grid electrode and has an output variably responsive to the intensity of current flowing through the grid electrode. A series-regulated stabilized power supply (preferably comprising a dc-dc converter and a current limiter) is operatively connected to the shunt-regulated stabilized power supply. A controller is operatively connected to the shunt-regulated stabilized power supply and the series-regulated stabilized power supply for controlling the output of the shunt-regulated stabilized power supply by controlling the series-regulated stabilized power supply in one of first and second modes wherein said series-regulated stabilized power supply supplies current to the shunt-regulated stabilized power supply in the first mode of the control and interrupts the supply of current to the shunt-regulated stabilized power supply in the second mode of the control.

23 Claims, 6 Drawing Sheets

| | Y (SW1,SW2) | C (SW1,SW2) | M (SW1,SW2) |
|---|---|---|---|
| $N_1$ | $V_1$ (off) | $V_2$ (off) | $V_3$ (on ) |
| $N_2$ | $V_4$ (off) | $V_5$ (on ) | $V_6$ (on ) |
| $N_3$ | $V_7$ (on ) | $V_8$ (on ) | $V_9$ (on ) |
| $N_4$ | $V_{10}$ (on ) | $V_{11}$ (on ) | $V_{12}$ (on ) |

SCOROTRON TYPE CHARGING APPARATUS

BACKGROUND OF THE INVENTION

1. Field of the Invention

The present invention relates to a scorotron type charging apparatus for charging the surface of the photoconductive body of, for example, an electrophotographic copying machine at a fixed potential and, more specifically, to a voltage controller for controlling the voltage of a grid electrode.

2. Description of the Related Art

As shown in FIG. 3, a scorotron type charging apparatus employed in an electrophotographic copying machine, in general, comprises a shielding case 1 formed of aluminum or the like and having an open lower end, a corona discharge electrode 2, such as a tungsten wire or the like, extended within the shielding case 1, a counter electrode 3 disposed opposite to the opening of the shielding case 1, a grid electrode 5 disposed between the shielding case 1 and the counter electrode 3, and a dc power source 4 for producing a corona. A bias voltage is applied to the grid electrode 5 to control the electrostatic potential of the surface of a photoconductive body 6, i.e., a charged body, placed between the corona discharge electrode 2 and the counter electrode 3. The scorotron type charging apparatus, as compared with a corotron type charging apparatus (not shown) which is not provided with any grid electrode, features the capability of uniformly charging the surface of a photoconductive body.

The bias voltage applied to the grid electrode 5 must be controlled to enhance the uniformity of the distribution of the electrostatic potential over the surface of the photoconductive body 6. The conventional scorotron type charging apparatus employs, as shown in FIG. 3, a parallel circuit consisting of a series constant-voltage dc power supply 7, i.e., a dc power supply having a control circuit connected in series to the load for voltage regulation, and a load resistor 8, connected in series between the grid electrode 5 and the counter electrode 3 to control the bias voltage. Another conventional scorotron type charging apparatus, as shown in FIG. 4, employs a parallel constant-voltage dc power supply 17, i.e., a dc power supply having a control circuit connected in parallel to the load for voltage regulation, connected to a grid electrode 5 and a counter electrode 3. A third conventional scorotron type charging apparatus, as shown in FIG. 5, employs a constant-voltage passive circuit 27 connected to a grid electrode 5 and a counter electrode 3. A constant-voltage passive device 27*a* as shown in FIG. 6(*a*) or a series circuit of a constant-voltage passive device 27*a* and a resistor 28 as shown in FIG. 6(*b*) is used as the constant-voltage passive circuit 27.

The conventional controller including the parallel circuit of the series constant-voltage dc power supply 7 and the load resistor 8 as shown in FIG. 3, however, consumes electricity uselessly by the load resistor 8, and is unable to change the voltage of the grid electrode 5 easily because the resistance of the load resistor 8 must be varied to vary the voltage of the grid electrode 5 over a wide range.

The controller employing the parallel constant-voltage dc power supply 17 as shown in FIG. 4 also has problems. The controller requires surplus power because the power provided through the control circuit by an unstable dc power supply (not shown, but included in the dc power supply 17) is very low, namely, the output conversion efficiency of the dc power supply 17 is very low, and the output efficiency of the parallel constant-voltage dc power supply 17 drops greatly when the voltage of the grid electrode 5 is varied over a wide range.

The controller employing the constant-voltage passive circuit 27 as shown in FIG. 5 is unable to control the voltage of the grid electrode 5 optionally with high accuracy because a voltage is applied to the grid electrode 5 in combination with the constant-voltage passive devices 27*a*, and through a selector switch 29 as shown in FIG. 7(*a*) or 7(*b*).

SUMMARY OF THE INVENTION

Accordingly, it is an object of the present invention to provide a scorotron type charging apparatus capable of optionally and accurately controlling the voltage of a grid electrode and reducing useless power consumption.

In one aspect of the present invention, a scorotron type charging apparatus comprises: a corona discharge electrode; a counter electrode disposed opposite to the corona discharge electrode; a corona producing power source for applying a voltage across the corona discharge electrode and the counter electrode; a grid electrode disposed between the corona discharge electrode and the counter electrode, wherein an objective body to be charged is interposed between the grid electrode and the counter electrode for charging; a shunt-regulated stabilized power supply connected to the grid electrode, the operating mode of the shunt-regulated stabilized power supply being varied responsive to the intensity of current caused to flow through the grid electrode by a corona discharge; a series stabilized power supply connected to the shunt-regulated stabilized power supply, the series stabilized power supply supplying a current to the shunt-regulated stabilized power supply; and control means provided to control selectively the series stabilized power supply in one of first and second modes, the series stabilized power supply in a first mode supplying the current to the shunt-regulated stabilized power supply, and the series stabilized power supply in a second mode interrupting the supply of current to the shunt-regulated stabilized power supply.

BRIEF DESCRIPTION OF THE DRAWINGS

The above and other objects, features and advantages of the present invention will become more apparent from reading the following description of the preferred embodiment taken in connection with the accompanying drawings, in which:

FIG. 1(*b*) is a circuit diagram of the block diagram of FIG. 1(*a*);

FIG. 1(*c*) is a map stored in the controller of FIGS. 1(*a*) and 1(*b*) for determining switch positions and voltages based on the type of toner and the number of chargings;

DETAILED DESCRIPTION OF THE PREFERRED EMBODIMENT

Figures 1A, 1C:
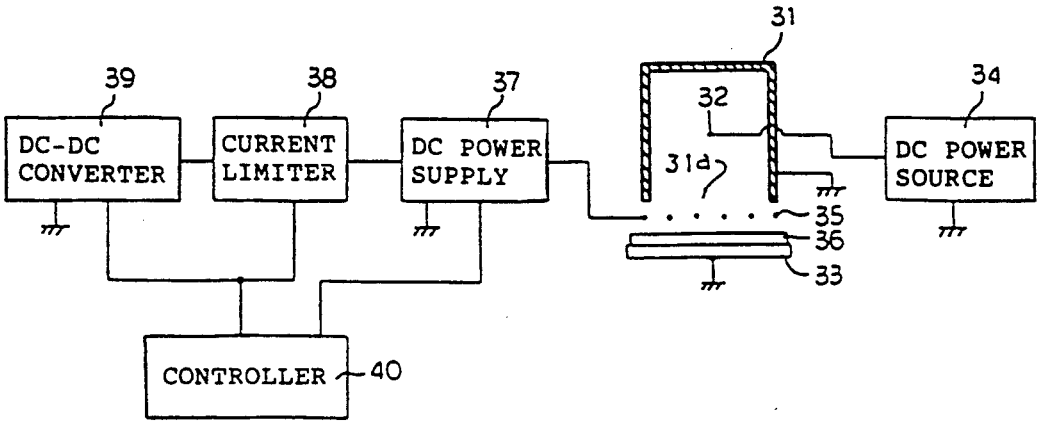
FIG. 1(*a*) is a block diagram of a scorotron type charging apparatus in a preferred embodiment according to the present invention.
Figure 1B:
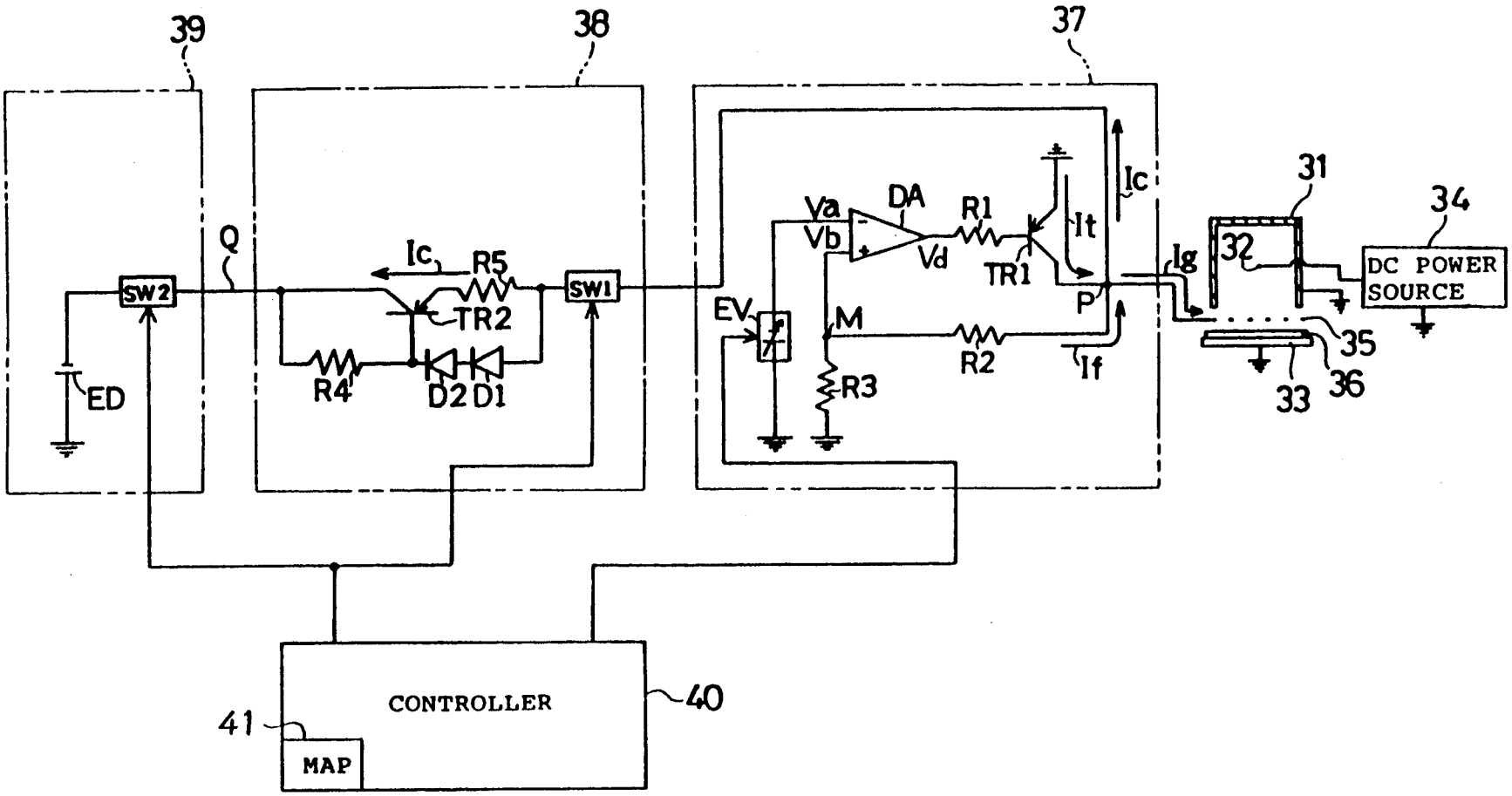
Figure 8:
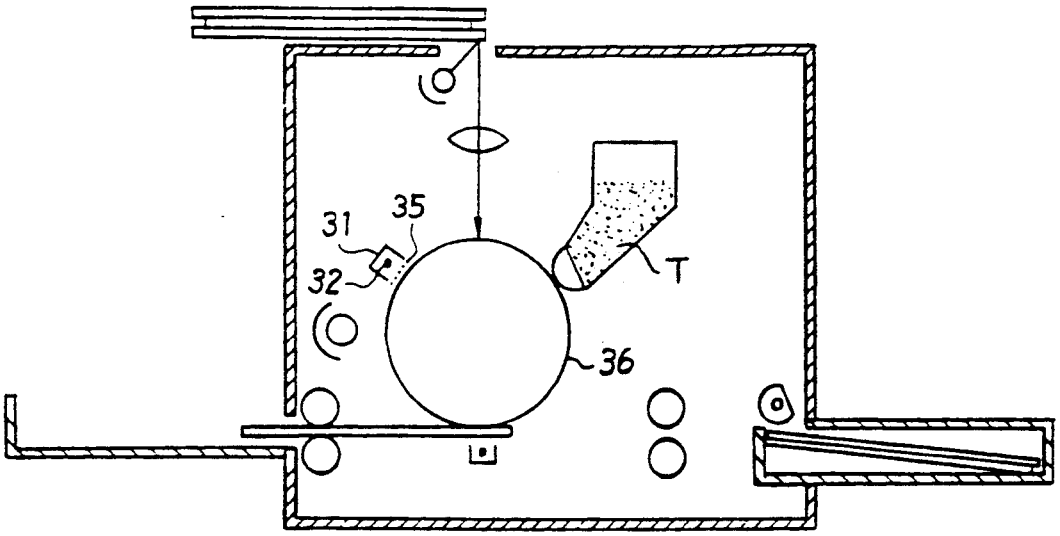
FIG. 8 is a schematic view of a copying machine employing the scorotron type charging apparatus of the present invention.

FIG. 1(*a*) is a block diagram of a scorotron type charging apparatus in a preferred embodiment according to the present invention. The apparatus can be used in the copying machine of FIG. 8 having a toner supply T. (Details of an exemplary copying machine are described in commonly assigned U.S. patent application Ser. No. 07/497,989 filed Mar. 23, 1990, the disclosure of which is herein incorporated by reference.) A corona discharge electrode 32, such as a tungsten wire, is extended in the central portion of the interior of a shielding case 31 formed of aluminum or the like and having a bottom opening 31*a*. A counter electrode 33 is disposed opposite to the corona discharge electrode 32 under the bottom opening 31*a*. The negative terminal of a dc power source 34 for producing a corona is connected to the corona discharge electrode 32. The positive terminal and the counter electrode 33 are connected to ground. The shielding case 31 is insulated from the corona discharge electrode 32 and is grounded.

A grid electrode 35 consisting of a plurality of wires or a mesh is disposed between the corona discharge electrode 32 and the counter electrode 33. The grid electrode 35 is connected to the negative terminal of a shunt-regulated stabilized dc power supply 37 which applies a bias voltage to the grid electrode 35 to enhance the uniformity of the distribution of the electrostatic potential over the surface of a photoconductive body 36. The positive terminal of the shunt-regulated stabilized dc power supply 37 and the counter electrode 33 are connected through the ground. The output circuit (including a transistor TR1 which is described afterward) of the shunt-regulated stabilized dc power supply 37 is driven by the current that flows from the grid electrode 35 to the corona discharge electrode 32 and the output current of a dc-dc converter 39, which will be described afterward. The shunt-regulated stabilized dc power supply 37 is connected to a controller 40. which controls the voltage to be applied to the grid electrode 35 by the shunt-regulated stabilized dc power supply 37.

One terminal of a series-regulated current limiter 38 is connected to the negative terminal of the shunt-regulated stabilized dc power supply 37 to supply a constant current to the shunt-regulated stabilized dc power supply 37. The other terminal of the current limiter 38 is connected to the negative terminal of the dc-dc converter 39, i.e., an astable dc power supply. The positive terminal of the dc-dc converter 39 is grounded. The controller 40 is also connected to the current limiter 38 and the dc-dc converter 39 for the simultaneous on-off control of the current limiter 38 and the dc-dc converter 39. The controller 40 controls the supply of power from the dc-dc converter 39 through the current limiter 38 to the shunt-regulated stabilized dc power supply 37. The series-regulated current limiter 38 and the dc-dc converter 39 constitute a series-regulated stabilized dc power supply.

Hereinafter, the block diagram shown in FIG. 1(*a*) will be explained in more detail referring to FIG. 1(*b*).

The shunt-regulated stabilized dc power supply 37 includes a PNP type transistor TR1 with a grounded emitter terminal and a collector terminal connected to grid electrode 35. The base terminal of the transistor TR1 is connected to the output terminal of an operational differential amplifier DA through a base resistor R1. A point P disposed between the grid electrode 35 and the collector terminal of the transistor TR1 is grounded through resistors R2 and R3. The series-regulated current limiter 38 is also connected to point P. The non-inverse input terminal of the operational differential amplifier DA is connected to a point M disposed between the resistors R2 and R3, and the inverse input terminal is connected to a variable power source EV which is controlled by the controller 40. The controller 40 determines the voltage Va of the variable power source EV based on parameters such as the type of toner and number of chargings of the photoconductive body, as detailed below with reference to FIG. 1(*c*)

An electrical switching circuit SW1 connected to the point P is provided in the current limiter 38. The switching circuit SW1 is connected to the emitter terminal of a PNP type transistor TR2 through a resistor R5 for sensing current, and connected to the base terminal of the transistor TR2 through diodes D1 and D2. A resistor R4 is provided between the base terminal and the collector terminal of the transistor TR2. A dc power source ED and an electrical switching circuit SW2 are provided in the dc-dc converter 39 and connected to the transistor TR2 in the current limiter 38. The switching circuits SW1 and SW2 are simultaneously controlled with respect to their ON-OFF states by the controller 40 based on parameters such as type of toner and number of chargings as discussed with reference to FIG. 1(*c*).

The voltage at a point Q is lowered when the switching circuits SW1 and SW2 are in the ON state. Following that, the voltage of the base terminal and collector terminal of the transistor TR2 is also lowered, and the transistor TR2 turns to the ON state. Thus, the collector current Ic is supplied to the transistor TR2 from the point P in the shunt-regulated stabilized dc power supply 37. If the collector current Ic exceeds a predetermined amount of current, and the sum of the voltage appearing at both ends of the resistor R5 plus the base-emitter voltage of the transistor TR2 is higher than the sum of the threshold voltage (a forward direction voltage) of the diodes D1 and D2, then the base-emitter current of the transistor TR2 is stopped and the collector current Ic is reduced toward the predetermined amount of current. If the collector current Ic is decreased below the predetermined amount of current, and the sum of the voltage appearing at both ends of the resistor R5 plus the base-emitter voltage of the transistor TR2 is lower than the sum of the threshold voltage of the diodes D1 and D2, then the base-emitter current of the transistor TR2 begins to flow and the collector current Ic is increased toward the predetermined amount of current. By repeating an operation of current feedback described above, the collector current Ic constantly stays at the predetermined amount of current.

In the shunt-regulated stabilized dc power supply 37, the voltage at the point P is stabilized at a predetermined voltage according to the setting voltage Va of the variable power source EV, i.e. the voltage Va at the inverse input terminal of the operational differential amplifier DA. Namely, now it is assumed that the voltage of the variable power source EV is set at a predetermined setting voltage Va by the controller 40 (based on parameters discussed below with reference to FIG. 1(*c*)). When the grid current Ig starts to flow as the result of the starting of the discharge from the corona discharge electrode 32, the feedback current If starts to flow through the resistors R2 and R3 and the voltage Vb at the point M lowers. The transistor TR1 stays in an OFF state while the absolute value of the voltage Vb is smaller that the absolute value of the voltage Va, because the output voltage Vd of the operational differential amplifier DA is as high as the ground voltage.

When the absolute value of the voltage Vb at the point M becomes greater than the absolute value of the voltage Va according to the increase of the grid current Ig, the output voltage Vd changes to a negative value, so that the transistor TR1 turns to the ON state and the collector current It of the transistor TR1 is supplied to the point P.

After that, the feedback current If is kept constant without increasing, and the deficiency of current for the grid current Ig is supplied from the collector current It. The grid current Ig is thus equal to the sum of the feedback current If and the collector current It of the transistor TR1 (i.e., Ig=If +It). As the result, the voltage at the point P is kept substantially constant. As described above, the voltage at the point P, i.e., the voltage of the grid electrode 35, is kept constant as the transistor TR1 acts suitably in the shunt-regulated stabilized dc power supply 37.

In the case where it is necessary to set the voltage of the grid electrode 35 lower and accordingly the setting voltage Va of the variable power source EV is set lower, a large amount of feedback current If should result. However, if the grid current Ig produced by the corona discharge is lacking, enough feedback current If will not flow, and the transistor TR1 never turns to the ON state, so that it becomes impossible to control the voltage at the point P to maintain the voltage at a set value. To solve the problem described above, in the scorotron type discharge apparatus according to the present preferred embodiment, if it is impossible to drive the transistor TR1 only by the grid current Ig, the controller 40 closes the switching circuit SW1 to place the current limiter 38 in an output state, and at the same time closes the switching circuit SW2 to place the dc-dc converter 39 in an active state. The opening or closing of the switching circuits SW1 and SW2 is determined by the controller 40 based on parameters discussed below with reference to FIG. 1(*c*). Enough current (the collector current Ic of the transistor TR2) to turn the transistor TR1 of the shunt-regulated stabilized dc power supply 37 to the ON state (in a manner similar to that discussed above) is supplied from the dc-dc converter 39 through the series-regulated current limiter 38. When the transistor TR1 is activated to the ON state, any deficiency in the grid current Ig is supplied from the collector current It. As described above, it is possible to control the grid voltage over a wide range.

The photoconductive body 36 of an electrophotographic color copying machine must be subjected to a plurality of charging cycles. The number of charging cycles is related to the number of copies desired, which is set by the operator. In FIG. 1(*c*), the number of chargings of the photoconductive body is represented by the variable $N_1$, $N_2$, $N_3$ and $N_4$, wherein each variable represents a range for the number of chargings. For example $N_1$ may represent a range of 0–10000 chargings, $N_2$ may represent a range of 10,000–30,000 chargings, $N_3$ may represent a range of 30,000–50,000 chargings, and $N_4$ may represent a range of chargings greater than 50,000. The photoconductive body, however, deteriorates as it is subjected to repeated chargings, and the degree of decay of the surface potential of the charged photoconductive body increases in a dark environment (i.e., dark decay increases). Accordingly, the surface potential must be controlled properly for each charging cycle based on the number of expected chargings.

In addition, a color copying machine generally uses three kinds of toner, namely a yellow toner, a cyan toner, and a magenta toner, each respectively represented by the variable Y, C and M in FIG. 1(*c*). The toners are delicately different from each other in charging characteristics, so the surface potential of the photoconductive body requires delicate control based on the type of toner.

The map of FIG. 1(*c*) is obtained from experimental data for optimizing the value of the setting voltage Va of the variable power source EV (e.g., $V_1$, $V_2$, . . . $V_{12}$) based on the type of toner (Y, C and M) and the number of expected chargings ($N_1$, $N_2$, $N_3$, $N_4$). When the voltage of the variable power source EV is set to a relatively low value (i.e., a large negative value), enough feedback current If may not flow, so the switches SW1, SW2 must be activated to the ON state depending on the type of toner, number of chargings and voltage Va for variable power source EV. The map of FIG. 1(*c*) is stored in the controller of FIG. 1(*b*), as represented by a portion 41 of the controller 40, e.g., stored in a Read Only Memory (ROM) 41. The controller 40 thus senses the type of toner and the desired number of chargings, and then sets the voltage ($V_1$ to $V_{12}$) for the variable power source EV and the ON/OFF state of the switches SW1, SW1.

The charging operation of the charging apparatus thus constructed will be described hereinafter.

Figure 2A:
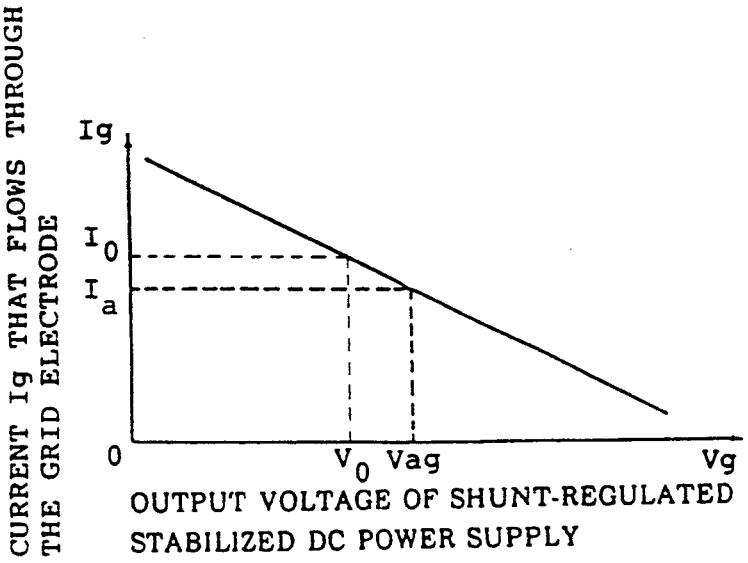
FIGS. 2(*a*) and (*b*) are graphs showing the variation of a current Ig flowing through a grid electrode when a corona discharge is produced with the output voltage Vg of a shunt-regulated stabilized power supply.
Figure 2B:
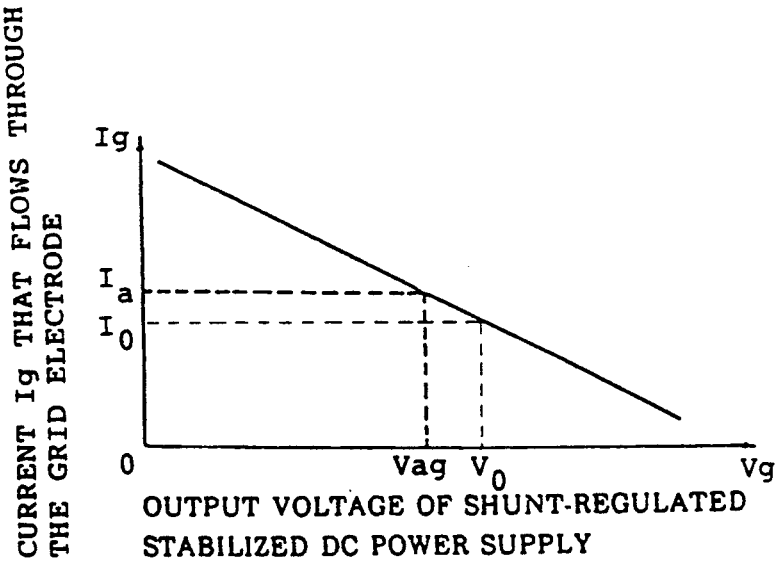
Figure 3:
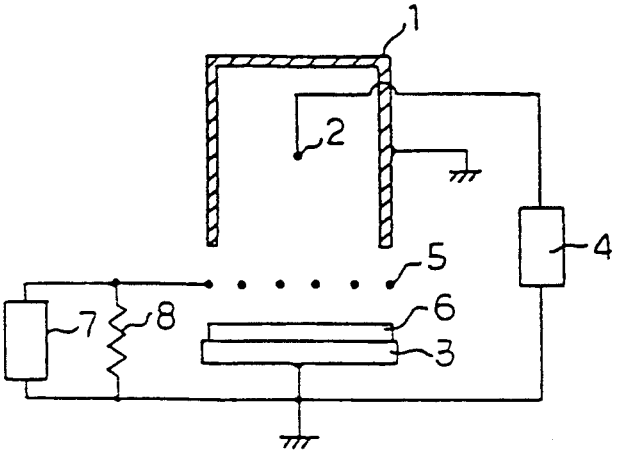
FIG. 3 PRIOR ART
FIG. 3 is a block diagram of a conventional charging apparatus employing a series constant-voltage power supply and a load resistor.
Figure 4:
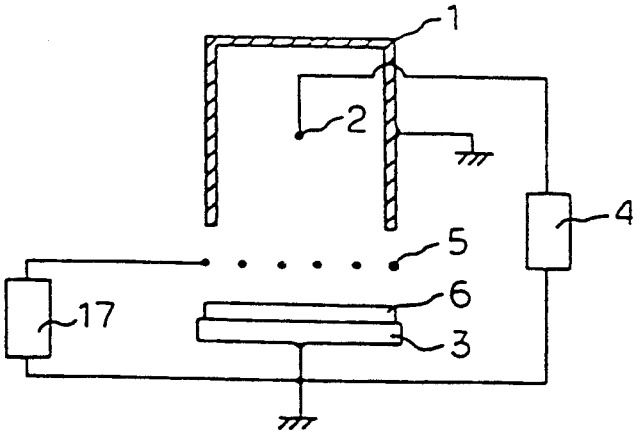
FIG. 4 PRIOR ART
FIG. 4 is a block diagram of a conventional charging apparatus employing a parallel constant-voltage power supply.
Figure 5:
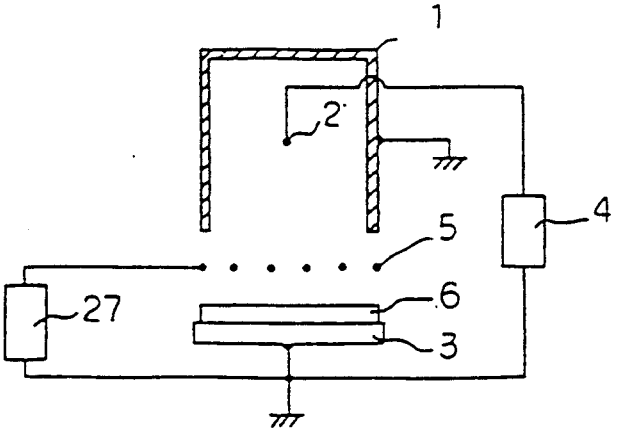
FIG. 5 PRIOR ART
FIG. 5 is a block diagram of a conventional charging apparatus employing a constant-voltage passive device.
Figure 6A:
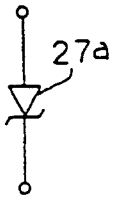
FIG. 6(a) PRIOR ART
FIGS. 6(*a*), 6(*b*), 7(*a*) and 7(*b*) are circuit diagrams of exemplary connections of the constant-voltage passive devices as shown in FIG. 5.
Figure 6B:
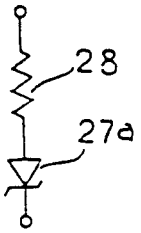
FIG. 6(b) PRIOR ART
Figure 7A:
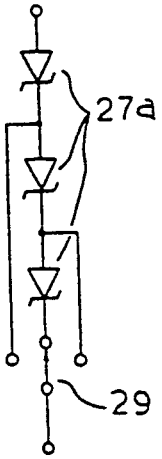
FIG. 7(a) PRIOR ART
Figure 7B:
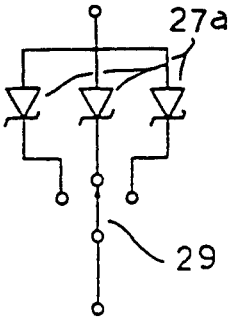
FIG. 7(b) PRIOR ART

First, the photoconductive body 36, i.e., a body to be charged, is disposed between the grid electrode 35 and the counter electrode 33 as shown in FIGS. 1(*a*) and 1(*b*). The controller 40 controls the output voltage of the shunt-regulated stabilized dc power supply 37 to be applied to the grid electrode 35 at a set voltage by determining from the map 41 (FIG. 1(*c*)) the voltage $V_1$ to $V_{12}$) for the variable power source EV and the ON/OFF state of the switches SW1, SW2 based on the type of toner and expected number of chargings. Referring to FIG. 2(*a*), when the absolute value of the current $I_o$ that flows through the grid electrode 35 is greater than the absolute value of a minimum current Ia necessary for driving the constant-voltage control circuit of the shunt-regulated stabilized dc power supply 37, namely, when the absolute value of the output voltage $V_o$ of the shunt-regulated stabilized dc power supply 37 is smaller than the absolute value of a voltage Vag shown in FIG. 2(*a*), the controller 40 turns off the switches SW1, SW2 connected to the current limiter 38 and the dc-dc converter 39. Consequently, the supply of power from the dc-dc converter 39 through the current limiter 38 to the shunt-regulated stabilized dc power supply 37 is interrupted. In this state, the photoconductive body 36 is charged at a predetermined potential by the corona discharge of the corona discharge electrode 32. In charging the photoconductive body 36, the electrostatic potential is limited by the voltage of the grid electrode 35 controlled by the shunt-regulated stabilized dc power supply 37.

Referring to FIG. 2(*b*), when the absolute value of the output voltage $V_o$ of the shunt-regulated stabilized dc power supply 37 applied to the grid electrode 35 is greater than the absolute value of the voltage Vag, the absolute value of the current flowing through the grid electrode 35 is smaller than the absolute value of the current Ia. Accordingly, the output circuit including the transistor TR1 of the shunt-regulated stabilized dc power supply 37 is unable to be driven only by the current flowing through the grid electrode 35. Therefore, the controller 40 turns on the switches SW1, SW2 simultaneously to supply power from the dc-dc converter 39 through the current limiter 38 to the constant-voltage control circuit of the shunt-regulated stabilized dc power supply 37. Thus, a constant voltage is applied to the grid electrode 35 by the shunt-regulated stabilized dc power supply 37 to charge the photoconductive body 36 at the set potential.

As is apparent from the foregoing description, the scorotron type charging apparatus in accordance with the present invention controls the voltage applied to the grid electrode by the shunt-regulated stabilized dc power supply when the absolute value of the voltage applied to the grid electrode is less than the minimum voltage Vag necessary to drive the transistor TR1 (FIG. 2(*a*)), and assists the shunt-regulated stabilized dc power supply by supplying power from the series-regulated stabilized dc power supply to the shunt-regulated stabilized dc power supply when the absolute value of the voltage applied to the grid electrode is greater than the minimum voltage Vag necessary to drive the transistor TR1 (FIG. 2(*b*)). Thus, the present invention utilizes effectively the shunt-regulated stabilized dc power supply operating at a low output conversion efficiency, which is an intrinsic disadvantage of the shunt-regulated stabilized dc power supply, reduces useless power consumption and controls the voltage of the grid electrode optionally and accurately.

It is noted that the map of FIG. 1(*c*) is determined by experimentation to set the optimum voltage $V_1$–$V_{12}$ and the ON/OFF state of the switches SW1, SW2, based on the type of toner and number of expected chargings. The actual voltage and/or states of the switches may vary. FIG. 1(*c*) is thus intended to be illustrative of the type of map that can be used by the controller.

It is also noted that the switches SW1 and SW2 can be eliminated when the absolute value of the desired output voltage Vg of the grid electrode is set at a voltage greater than the absolute value of the voltage Vag. In this situation, the absolute value of the current flowing through the grid electrode 35 is small so that the dc-dc converter 39 and the current limiter 38 always supply current to the dc power supply 37 (see FIG. 2(*b*)). The operator can set the voltage instead of the controller.

Further, the present invention has been described in detail with reference to the preferred embodiments thereof, which are intended to be illustrative and not limiting. Various changes may be made by those skilled in the art without departing from the spirit and scope of the invention as defined in the following claims.

What is claimed is:

1. A grid electrode voltage control apparatus for a scorotron charging device having a corona discharge electrode operatively connected to a corona producing power source and disposed opposite a counter electrode, and having a grid electrode disposed between said corona discharge electrode and said counter electrode, comprising:

a shunt-regulated stabilized power supply operatively connected to said grid electrode and having an output variably responsive to the intensity of current flowing through said grid electrode;

a series-regulated stabilized power supply operatively connected to said shunt-regulated stabilized power supply; and control means operatively connected to said shunt-regulated stabilized power supply and said series-regulated stabilized power supply for controlling the output of the shunt-regulated stabilized power supply by controlling said series-regulated stabilized power supply in one of first and second modes wherein said series-regulated stabilized power supply supplies current to the shunt-regulated stabilized power supply in said first mode of the control means and interrupts the supply of current to the shunt-regulated stabilized power supply in said second mode of the control means.

2. The control apparatus of claim 1, wherein said series-regulated stabilized power supply comprises:

dc-dc converter means for producing an astable dc power supply; and current limiter means operatively connecting said shunt-regulated stabilized power supply with said dc-dc converter means for limiting current flowing between said shunt-regulated stabilized power supply and said dc-dc converter means;

at least one of said current limiter means and said dc-dc converter means being operatively connected to said control means and responsive to said first and second modes.

3. The control apparatus of claim 2, wherein both of said current limiter means and said dc-dc converter means are operatively connected to said control means and simultaneously responsive to said first and second modes.

4. The control apparatus of claim 2, wherein the current limiter means supplies a constant current to the shunt-regulated stabilized power supply in response to the first mode of the control means.

5. The control apparatus of claim 1, wherein the control means operates the series-regulated stabilized power supply in one of the first and second modes responsive to a difference between current flowing through the grid electrode and a minimum current necessary for driving the shunt-regulated stabilized power supply.

6. The control apparatus of claim 5 wherein the control means operates the series-regulated stabilized power supply in the second mode when an absolute value of the current flowing in the grid electrode is greater than an absolute value of the minimum current.

7. The control apparatus of claim 5, wherein the control means operates the series regulated stabilized power supply in the first mode when an absolute value of the current flowing in the grid electrode is less than an absolute value of the minimum current.

8. The control apparatus of claim 1 wherein the shunt-regulated stabilized power supply includes a variable power source, and the control means selects one of the first and second modes, and selects a predetermined setting voltage from a plurality of predetermined setting voltages stored in a map.

9. The control apparatus of claim 8, wherein the controller means selects the setting voltage responsive to a toner used with an objective body to be charged.

10. The control apparatus of claim 8, wherein the controller means selects the setting voltage responsive to a cumulative number of chargings.

11. A scorotron type charging apparatus for a copying machine comprising:

a corona discharge electrode;

a counter electrode opposite to the corona discharge electrode;

a corona producing power source for applying a voltage across the corona discharge electrodes and the counter electrode;

a grid electrode disposed between the corona discharge electrode and the counter electrode, an objective body to be charged being disposed between the grid electrode and the counter electrode;

a shunt-regulated stabilized power supply operatively connected to said grid electrode and having an output variably responsive to the intensity of current flowing through said grid electrode;

a series-regulated stabilized power supply operatively connected to said shunt-regulated stabilized power supply; and control means operatively connected to said shunt-regulated stabilized power supply and said series-regulated stabilized power supply for controlling the output of the shunt-regulated stabilized power supply by controlling said series-regulated stabilized power supply in one of first and second modes wherein said series-regulated stabilized power supply supplies current to the shunt-regulated stabilized power supply in said first mode of the control means and interrupts the supply of current to the shunt-regulated stabilized power supply in said second mode of the control means.

12. The apparatus of claim 11, wherein said series-regulated stabilized power supply comprises:

dc-dc converter means for producing an astable dc power supply; and current limiter means operatively connecting said shunt-regulated stabilized power supply with said dc-dc converter means for limiting current flowing between said shunt-regulated stabilized power supply and said dc-dc converter means;

at least one of said current limiter means and said dc-dc converter means being operatively connected to said control means and responsive to said first and second modes.

13. The apparatus of claim 12, wherein both of said current limiter means and said dc-dc converter means are operatively connected to said control means and simultaneously responsive to said first and second modes.

14. The apparatus of claim 12, wherein the current limiter means supplies a constant current to the shunt-regulated stabilized power supply in response to the first mode of the control means.

15. The apparatus of claim 11, wherein the control means operates the series regulated stabilized power supply in one of the first and second modes responsive to a difference between current flowing through the grid electrode and a minimum current necessary for driving the shunt-regulated stabilized power supply.

16. The apparatus of the claim 15, wherein the control means operates the series-regulated stabilized power supply in the second mode when an absolute value of the current flowing in the grid electrode is greater than an absolute value of the minimum current.

17. The apparatus of claim 15, wherein the control means operates the series regulated stabilized power supply in the first mode when an absolute value of the current flowing in the grid electrode is less than an absolute value of the minimum current.

18. The apparatus of claim 11 wherein the shunt-regulated stabilized power supply includes a variable power source, and the control means selects a predetermined setting voltage from a plurality of predetermined setting voltages for the variable power source and one of the first and second modes.

19. The apparatus of claim 18, wherein the control means selects the setting voltage in response to a type of toner used with the objective body.

20. The apparatus of claim 18, wherein the control means selects the voltage setting in response to a number of chargings of the objective body.

21. A grid electrode voltage control apparatus of a scorotron charging device having a corona discharge electrode operatively connected to a corona producing power source and disposed opposite a counter electrode, and having a grid electrode disposed between said corona discharge electrode and said counter electrode, comprising:

first circuit means operatively connected to the grid electrode and including voltage feedback means for sensing a voltage of the grid electrode and maintaining the voltage of the grid electrode at a desired voltage;

second circuit means operatively connected to the first circuit means for supplying a constant current to the first circuit means; and control means for interrupting the connecting between the first and second circuit means, based on a level of the desired voltage for the grid electrode.

22. The control apparatus of claim 21, wherein said control means determines the desired voltage to be applied to the grid electrode.

23. The control apparatus of claim 21, wherein the control means controls the supply of current from the second circuit means to the first circuit means responsive to the difference between current flowing through the grid electrode and a minimum current necessary for driving the first circuit means.

* * * * *